US012766427B2

(12) United States Patent
Makita

(10) Patent No.: US 12,766,427 B2
(45) Date of Patent: Oct. 20, 2026

(54) HANDHELD ITEM FOR FIGURE

(71) Applicant: EPOCH COMPANY, LTD., Tokyo (JP)

(72) Inventor: Shun Makita, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 160 days.

(21) Appl. No.: 18/933,169

(22) Filed: Oct. 31, 2024

(65) Prior Publication Data

US 2025/0135365 A1 May 1, 2025

(30) Foreign Application Priority Data

Nov. 1, 2023 (JP) ..... 2023-187376

(51) Int. Cl.
*A63H 3/36* (2006.01)

(52) U.S. Cl.
CPC ..... *A63H 3/365* (2013.01)

(58) Field of Classification Search
CPC . A63H 3/36; A63H 3/365; A63H 3/46; A63H 3/20
USPC ..... 446/268, 321, 327, 369, 376, 378, 390
See application file for complete search history.

(56) References Cited

U.S. PATENT DOCUMENTS 4,985,008 A * 1/1991 Price ..... A63H 3/48 446/354
5,362,271 A * 11/1994 Butt ..... A63H 3/36 446/139
2004/0116041 A1* 6/2004 Isenberg ..... A63J 19/00 446/331
2015/0321109 A1* 11/2015 Fukuchi ..... A63H 3/46 446/376
2019/0388796 A1* 12/2019 Vanderbeek ..... A63H 13/10
2023/0241524 A1* 8/2023 Webb ..... A63H 3/02 446/321

FOREIGN PATENT DOCUMENTS

JP H01-159892 U 11/1989

* cited by examiner

*Primary Examiner* — Peter M Poon
(74) *Attorney, Agent, or Firm* — Faegre Drinker Biddle & Reath LLP

(57) ABSTRACT

A handheld item for a figure includes: an opening portion; a step portion formed in a step shape from a part of an inner wall within the opening portion; a recess portion provided on an inner side of the step portion within the opening portion, the recess portion being configured to allow at least a part of a hand of the figure to be inserted into the recess portion; and a pair of bulging portions bulging inward from a pair of opposing inner walls defining the recess portion. An opening end of the recess portion is formed in a substantially regular hexagonal shape in a plan view of the opening portion.

4 Claims, 5 Drawing Sheets

HANDHELD ITEM FOR FIGURE

CROSS-REFERENCE TO RELATED APPLICATIONS

This application is based on and claims priority under 35 USC 119 from Japanese Patent Application No. 2023-187376 filed on Nov. 1, 2023, the contents of which are incorporated herein by reference.

TECHNICAL FIELD

The present disclosure relates to a handheld item for a figure.

BACKGROUND ART

In the related art, a handheld item for a figure, such as an accessory that is attached to a hand of the figure, is provided. For example, JPH01-159892U discloses an attachment member for a figure accessory for allowing the figure to hold an accessory in its hand. The attachment member for a figure accessory includes a fitting portion having a substantially C-shaped cross-section, which is formed to fit and detach freely with respect to a wrist of the figure. Consequently, an accessory, such as a flower, can be attached to the figure through the attachment member.

SUMMARY OF INVENTION

A size of the figure's hand to which the accessory is attached varies depending on a size of the figure. However, the attachment member for a figure accessory disclosed in JPH01-159892U is difficult to be adapted to figures of various sizes because a size of the fitting portion is fixed.

An object of the present disclosure is to provide a handheld item for a figure, which can be adapted to figures of various sizes.

A handheld item for a figure of the present disclosure includes: an opening portion; a step portion formed in a step shape from a part of an inner wall within the opening portion; a recess portion provided on an inner side of the step portion within the opening portion, the recess portion being configured to allow at least a part of a hand of the figure to be inserted into the recess portion; and a pair of bulging portions bulging inward from a pair of opposing inner walls within the recess portion, in which an opening end of the recess portion is formed in a substantially regular hexagonal shape in a plan view of the opening portion.

According to the present disclosure, it is possible to provide a handheld item for a figure, which can be adapted to figures of various sizes.

BRIEF DESCRIPTION OF DRAWINGS

The present disclosure will be described in detail based on the following without being limited thereto, wherein:

FIGS. 1A and 1B are overall perspective views of a piping bag model according to an embodiment of the present disclosure, in which FIG. 1A is an overall perspective view of the piping bag model as viewed from the front side, and FIG. 1B is an overall perspective view of the piping bag model as viewed from the rear side;

DESCRIPTION OF EMBODIMENTS

Figure 1B:
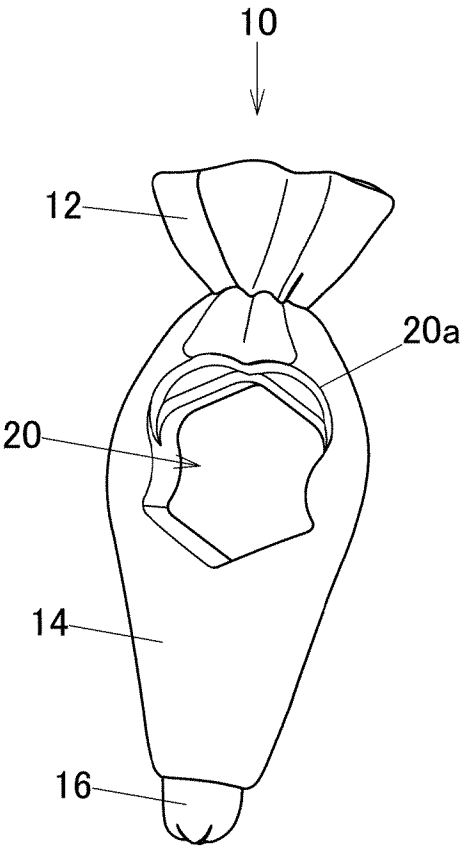

An embodiment of the present disclosure will be described with reference to the drawings. As shown in FIG. 1A, in an embodiment of the present disclosure, a piping bag model (a handheld item for a FIG. 10) that imitates a cream piping bag used for cake decoration and the like is exemplified. The piping bag model 10 is a model toy that can be attached to a hand of a figure model for playing a pretend bakery game. The piping bag model 10 is formed in an overall longitudinally elongated, roughly flattened oval shape and includes a closure portion 12, a main body portion 14, and a nozzle portion 16. A part of the main body portion 14 is provided with an opening portion 20 that is widely opened (see FIG. 1B).

The closure portion 12 has a shape that imitates a closed upper portion of a bag portion of the cream piping bag, in which cream is enclosed. The main body portion 14 has a shape that imitates the bag portion of the cream piping bag, in which cream is enclosed. The nozzle portion 16 has a shape that imitates a nozzle portion of the cream piping bag, from which cream is dispensed. In the following, the closure portion 12 side of the piping bag model 10 is referred to as an upper side of the piping bag model 10, the nozzle portion 16 side is referred to as a lower side of the piping bag model 10, a side of the main body portion 14 on which the opening portion 20 is provided is referred to as a rear side of the piping bag model 10, and an opposite side is referred to as a front side of the piping bag model 10.

Figure 1A:
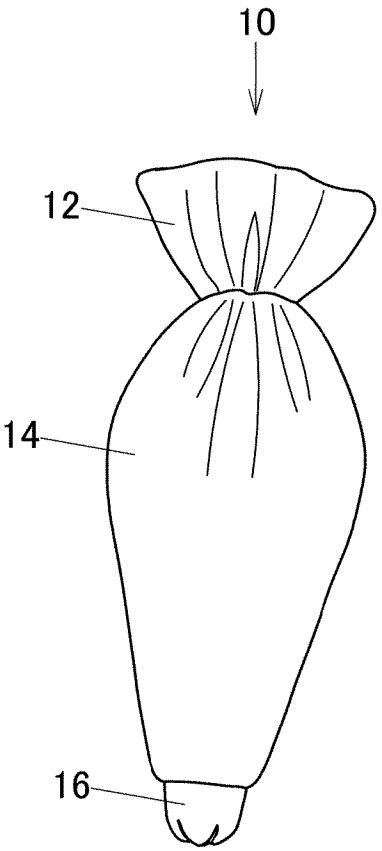
Figure 2:
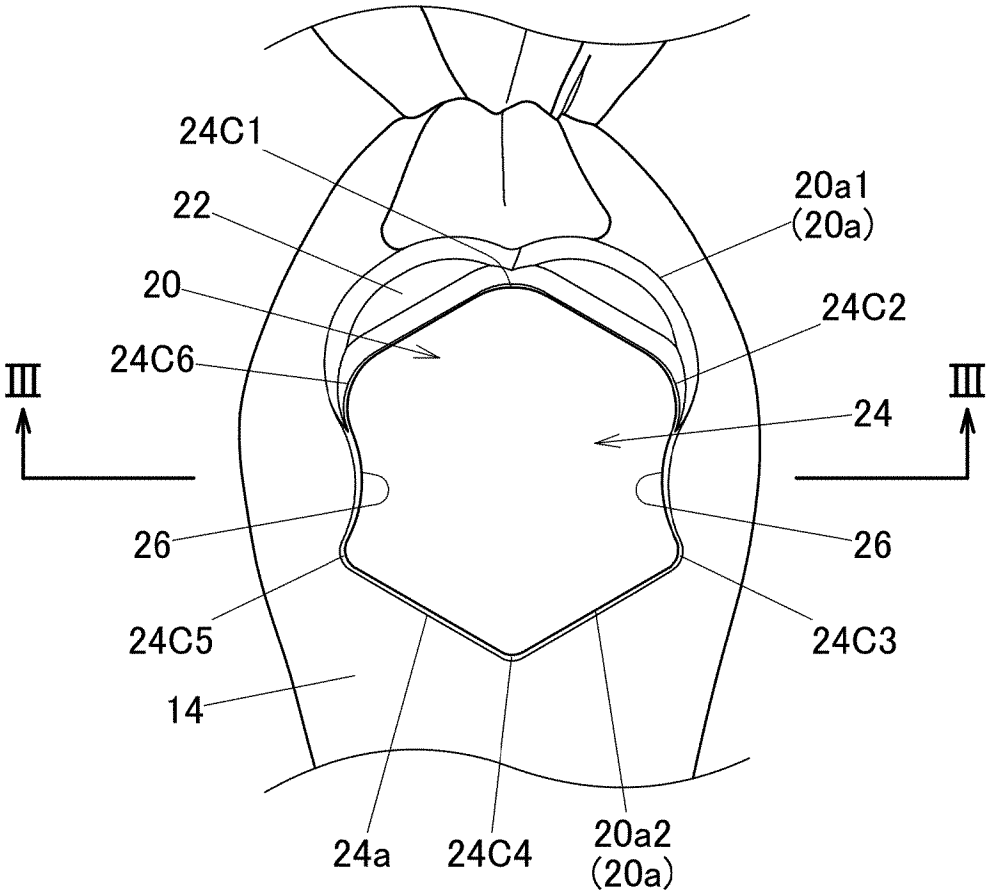
FIG. 2 is a plan view of the piping bag model according to the embodiment of the present disclosure as viewed from the rear side.

As shown in FIGS. 1B and 2, the opening portion 20 has a bilaterally symmetrical shape. An opening end 20*a* of the opening portion 20 is configured by an opening end of an upper portion (hereinafter, referred to as "upper opening end 20*a*1") formed by two curved lines and an opening end of a lower portion (hereinafter, referred to as "lower opening end 20*a*2") formed by two straight lines. On an inner wall located on an inner side of the upper opening end 20*a*1, a step portion 22 in the form of a step is provided.

On an inner side of the step portion 22, a recess portion 24 recessed toward the front side is provided. At least a part of a hand of a figure model is inserted into the recess portion 24. A part of an opening end 24*a* of the recess portion 24 is defined by a part of an end edge of the step portion 22 on an opposite side to the upper opening portion 20*al* side, and the other the other part thereof is defined by a part of the opening end 20*a* of the opening portion 20. As shown in FIG. 2, the opening end 24*a* of the recess portion 24 has a substantially regular hexagonal shape when viewed in plan. Accordingly, the recess portion 24 includes six corner portions (hereinafter, an upper corner portion is referred to as a "first corner portion 24C1", and other corners are referred to as a "second corner portion 24C2", a "third corner portion 24C3", a "fourth corner portion 24C4", a "fifth corner portion 24C5", and a "sixth corner portion 24C6" in clockwise order from the "first corner portion 24C1").

All the six corner portions of the first corner portion 24C1 to the sixth corner portion 24C6 have a rounded shape. Among these, the first corner portion 24C1 and the fourth corner portion 24C4, the second corner portion 24C2 and the fifth corner portion 24C5, and the third corner portion 24C3 and the sixth corner portion 24C6 face each other on diagonal lines of the recess portion 24, respectively. In addition, among inner walls within the recess portion 24, an inner wall between the second corner portion 24C2 and the third corner portion 24C3, and an inner wall between the fifth corner portion 24C5 and the sixth corner portion 24C6 are formed as bulging portions 26 formed to bulge slightly inward. Both the bulging portions 26 and 26 have a bilaterally symmetrical shape and are formed to bulge inward in a substantially circular arc shape when viewed in plan.

Figure 3:
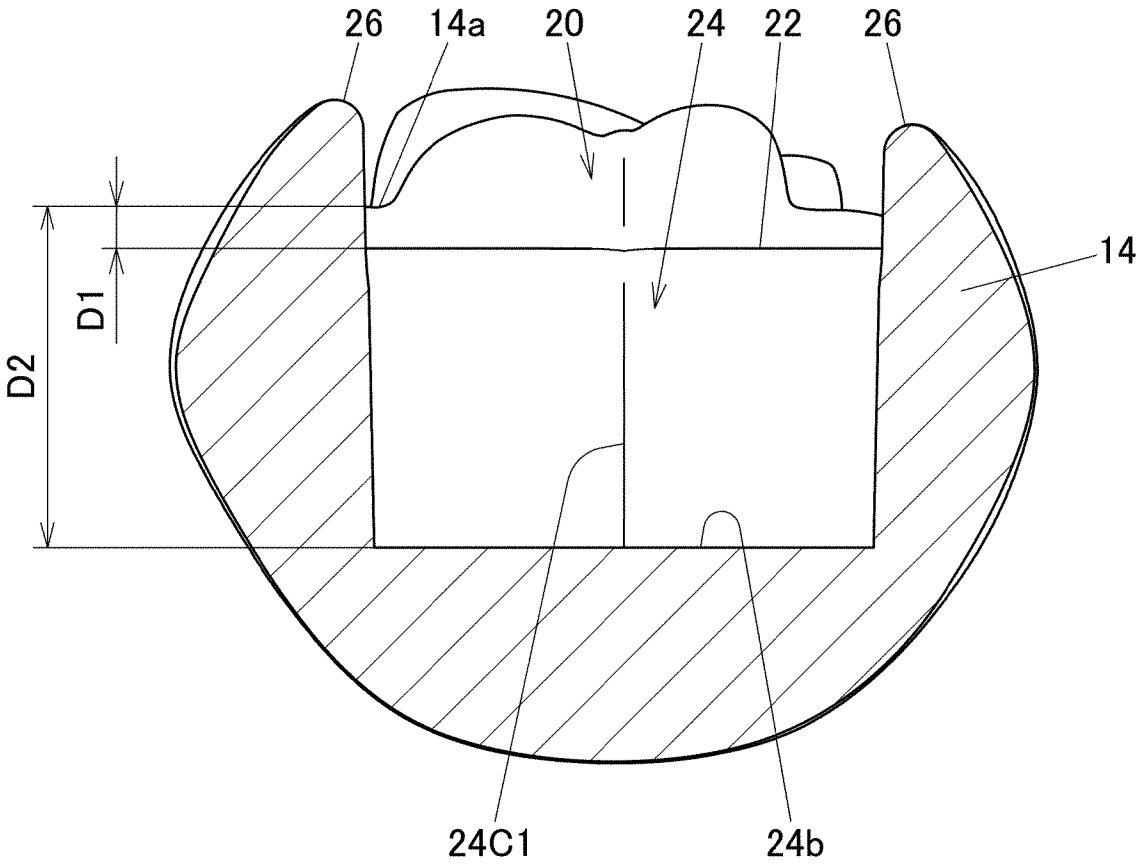
FIG. 3 is a cross-sectional view taken along line III-III in FIG. 2, showing the piping bag model according to the embodiment of the present disclosure.

A bottom surface 24*b* of the recess portion 24 (see FIG. 3) is provided to be sufficiently wider than the step portion 22. As shown in FIG. 3, a depth dimension D2 from a surface 14*a* of the main body portion 14 near the opening portion 20 to the bottom surface 24*b* of the recess portion 24 is formed greater than a depth dimension D1 from the surface 14*a* to the step portion 22. For this reason, when the hand of the figure model is inserted into the recess portion 24, most or all of the hand is stored in the recess portion 24, and a part of the hand of the figure model either comes into contact with the step portion 22 or does not come into contact at all, depending on a size of the hand of the figure model.

Figure 4B:
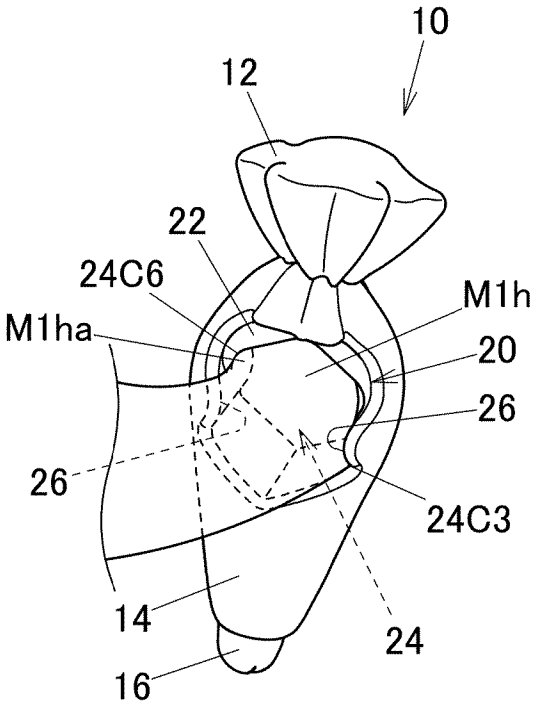
FIG. 4B is an enlarged perspective view of a vicinity of the hand of the figure model to which the piping bag model in FIG. 4A is attached, as viewed from the rear side.
Figure 4A:
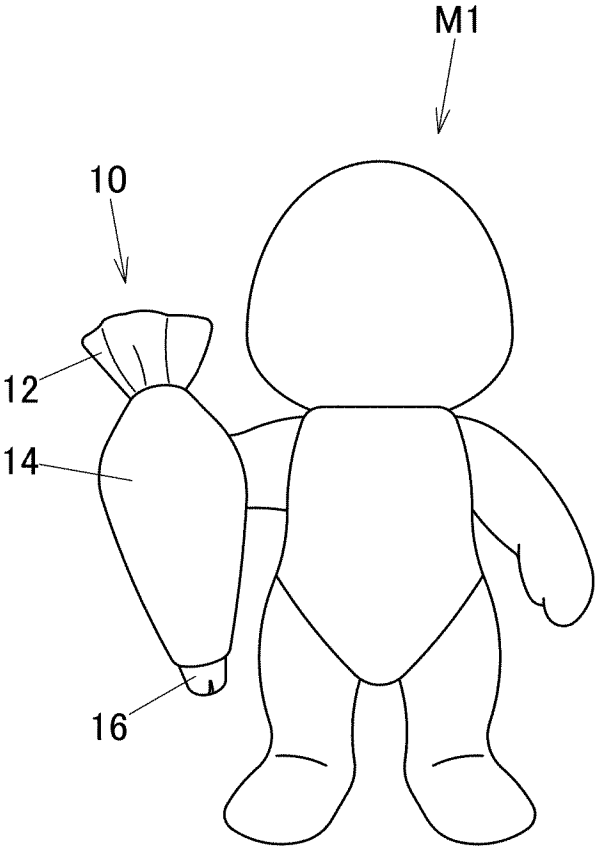
FIG. 4A is a schematic view showing an entire small figure model with the piping bag model according to the embodiment of the present disclosure attached to a hand.
Figure 5B:
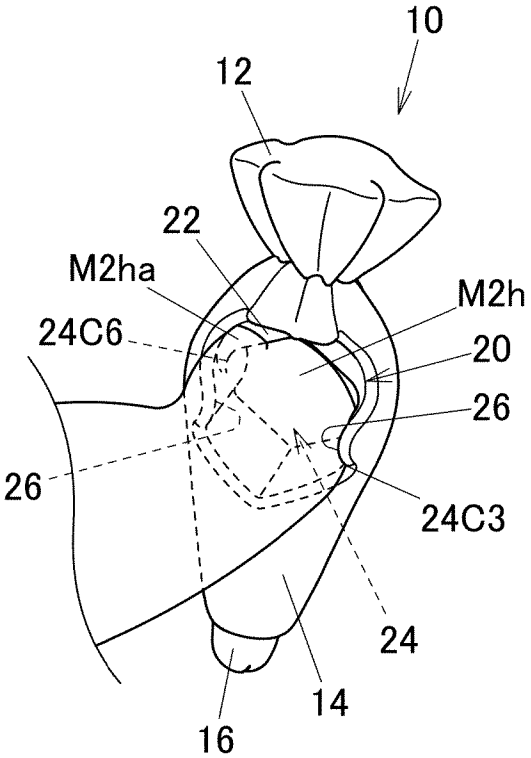
FIG. 5B is an enlarged perspective view of a vicinity of the hand of the figure model to which the piping bag model in FIG. 5A is attached, as viewed from the rear side.
Figure 5A:
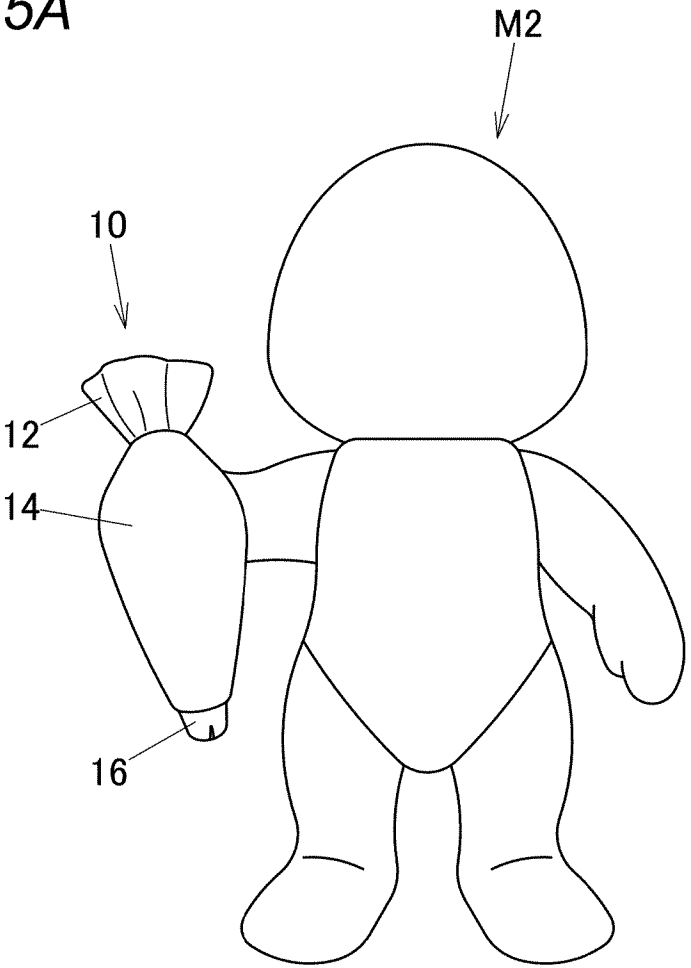
FIG. 5A is a schematic view showing an entire large figure model with the piping bag model according to the embodiment of the present disclosure attached to a hand.

Next, insertion aspects when the right hands of figure models of different sizes are inserted into the recess portion 24 of the piping bag model 10 will be described with reference to FIGS. 4A and 4B and FIGS. 5A and 5B. FIGS. 4A and 4B illustrate an insertion aspect when a small figure model imitating a child figure (hereinafter, referred to as "small figure model M1") is used, and FIGS. 5A and 5B illustrate an insertion aspect when a large figure model imitating an adult figure (hereinafter, referred to as "large figure model M2") is used. Note that FIGS. 4A and 4B exemplify an insertion aspect in a case where the right hand M1*h* of the small figure model M1 is sized to fit exactly within the recess portion 24, and FIGS. 5A and 5B exemplify an insertion aspect in a case where the right hand M2*h* of the large figure model M2 is sized such that a part thereof protrudes from the recess portion 24.

As shown in FIGS. 4A and 4B, when the right hand M1*h* of the small figure model M1 is inserted into the recess portion 24, the right hand M1*h*, including the thumb M1*ha*, is entirely stored in the recess portion 24 and is held while being pressed inward by both the bulging portions 26 and 26. At this time, the direction of the right hand M1*h* can be adjusted and positioned so that both sides of the right hand M1*h* are located at the two corner portions (in the example shown in FIGS. 4A and 4B, the third corner portion 24C3 and the sixth corner portion 24C6) on the diagonal line of the recess portion 24. For this reason, the piping bag model 10 can be reliably held in any direction on the right hand M1*h* of the small figure model M1.

In this way, in the case of a figure model with a small hand, the hand is entirely stored in the recess portion 24 and held while being pressed inward by both the bulging portions 26 and 26. Additionally, by positioning both sides of the hand at the two corner portions located on the diagonal line of the recess portion 24, the hand can be held in any direction.

On the other hand, as shown in FIGS. 5A and 5B, when the right hand M2*h* of the large figure model M2 is inserted into the recess portion 24, the entire right hand M2*h* cannot be stored in the recess portion 24, and a portion excluding the thumb M2*ha* is stored in the recess 24, and the thumb M2*ha* is supported while being placed on the step portion 22. Both sides of the portion, excluding the thumb M2*ha*, are positioned by being fitted into two corner portions (in the example shown in FIGS. 5A and 5B, the third corner portion 24C3 and the sixth corner portion 24C6) located on the diagonal line of the recess portion 24 in a manner of avoiding both the bulging portions 26 and 26, and portions facing both the bulging portions 26 and 26 are supported by both the bulging portions 26 and 26.

In this way, in the case of a figure model with a large hand, a part of the hand protruding from the recess portion 24 is supported while being placed on the step portion, and the other part is stored in the recess portion 24 in a manner of avoiding both the protruding portions 26 and 26, and both sides thereof are fitted into two corner portions located on the diagonal line of the recess portion 24. By doing so, while the portion stored in the recessed portion 24 is positioned by the two corner portions (in other words, while the direction of the hand is adjusted), the portions facing both the bulging portions 26 and 26 are supported by both the bulging portions 26 and 26 and held in the recess portion 24.

As described above, the piping bag model 10 according to the embodiment of the present disclosure can be held by the hand of the figure, regardless of whether the hand size of the figure is small or large. Thus, it is possible to implement the piping bag model 10 that can be adapted to figures of various sizes.

According to the embodiment of the present disclosure, a handheld item for a figure of the following aspects can be provided.

A handheld item for a figure according to a first aspect includes an opening portion; a step portion formed in a step shape from a part of an inner wall within the opening portion; a recess portion provided on an inner side of the step portion within the opening portion, the recess portion being configured to allow at least a part of a hand of the figure to be inserted into the recess portion; and a pair of bulging portions bulging inward from a pair of opposing inner walls defining the recess portion, in which an opening end of the recess portion is formed in a substantially regular hexagonal shape in a plan view of the opening portion.

With this configuration, in the case of a figure with small hands, the hand is entirely stored in the recess portion and held by being pressed inward by both the bulging portions. Additionally, by positioning both sides of the hand at two corner portions located on a diagonal line of the recess portion in which the opening end is formed in a substantially regular hexagonal shape, the hand can be held in any direction. On the other hand, in the case of a figure with large hands, a part of the hand protruding from the recess portion is placed and supported on the step portion, and the other part is stored in the recess portion in a manner of avoiding both the bulging portions, and both sides thereof are fitted into two corner portions located on the diagonal line of the recess portion. That is, while the portion stored in the recessed portion is positioned by the two corner portions, the portions facing both the bulging portions are supported by both the bulging portions and held in the recess portion.

Consequently, it is possible to provide a handheld item for a figure, which can be adapted to figures of various sizes.

In the handheld item for a figure according to a second aspect, the pair of bulging portions is formed in a substantially circular arc shape in the plan view of the opening portion. With this configuration, compared to a case where both bulging portions have an angular shape, it is less likely for a part of the figure's hand to be injured, and an area where both the bulging portions come into contact with a part of the figure's hand becomes larger, allowing the bulging portions to effectively hold and support the figure's hand.

In the handheld item for a figure according to a third aspect, the pair of bulging portions is symmetrical to each other in shape. With this configuration, since the aspects of holding and supporting parts of the hand of the figure by the respective bulging portions are substantially the same, a part of the hand of the figure can be held and supported in an arbitrary direction by both the bulging portions.

In the handheld item for a figure according to a fourth aspect, each of six corner portions of the recess portion forming the substantially regular hexagonal shape has a rounded shape. With this configuration, compared to a case where each corner portion has an angular shape, it is possible to make it difficult for a part of the figure's hand, which is fitted and positioned at two corner portions located on the diagonal line of the recess portion, to be injured.

Although the embodiments of the present disclosure have been described, the present disclosure is not limited to the above-described embodiments and can be variously changed without departing from the scope thereof. For example, in the above embodiment, the piping bag model imitating a cream piping bag has been exemplified as a handheld item for a figure, but no such limitation is intended, and models imitating various things can be used.

What is claimed is:

1. A handheld item for a figure comprising:

an opening portion;

a step portion formed in a step shape from a part of an inner wall within the opening portion;

a recess portion provided on an inner side of the step portion within the opening portion, the recess portion being configured to allow at least a part of a hand of the figure to be inserted into the recess portion; and a pair of bulging portions bulging inward from a pair of opposing inner walls defining the recess portion, wherein an opening end of the recess portion is formed in a substantially regular hexagonal shape in a plan view of the opening portion.

2. The handheld item for the figure according to claim 1, wherein the pair of bulging portions is formed in a substantially circular arc shape in the plan view of the opening portion.

3. The handheld item for the figure according to claim 1, wherein the pair of bulging portions is symmetrical to each other in shape.

4. The handheld item for the figure according to claim 1, wherein each of six corner portions of the recess portion forming the substantially regular hexagonal shape has a rounded shape.

* * * * *